US005295282A

United States Patent [19]

Lautenschläger

[11] Patent Number: 5,295,282

[45] Date of Patent: Mar. 22, 1994

[54] MOUNTING PLATE FOR FURNITURE HINGES

[75] Inventor: Horst Lautenschläger, Reinheim, Fed. Rep. of Germany

[73] Assignee: MEPLA-Werke Lautenschlager GmbH & Co. KG, Fed. Rep. of Germany

[21] Appl. No.: 961,434

[22] Filed: Oct. 15, 1992

[30] Foreign Application Priority Data

Oct. 23, 1991 [DE] Fed. Rep. of Germany ..... 4134828

[51] Int. Cl.[5] ..... E05D 7/04

[52] U.S. Cl. ..... 16/237; 16/248

[58] Field of Search ..... 16/237, 248, 249, DIG. 43

[56] References Cited

U.S. PATENT DOCUMENTS

| | | | |
|---|---|---|---|
| 4,703,539 | 11/1987 | Lautenschlager, Jr. et al. | 16/DIG. 43 |
| 4,785,497 | 11/1988 | Salice | 16/237 |
| 4,800,625 | 1/1989 | Salice | 16/237 |
| 4,976,006 | 12/1990 | Lautenschlager | 16/DIG. 43 |
| 4,982,475 | 1/1991 | Killingstad | 16/DIG. 43 |
| 5,105,506 | 4/1992 | Lin | 16/DIG. 43 |

FOREIGN PATENT DOCUMENTS

| | | | |
|---|---|---|---|
| 374551 | 5/1984 | Austria . | |
| 2751459 | 6/1978 | Fed. Rep. of Germany . | |
| 2720096 | 11/1978 | Fed. Rep. of Germany | 16/237 |
| 3943330 | 7/1991 | Fed. Rep. of Germany . | |
| 7609706 | 4/1976 | France . | |

*Primary Examiner*—Paula A. Bradley
*Assistant Examiner*—Chuck Y. Mah

[57] ABSTRACT

In a mounting plate (10) configured as a wing plate for the adjustable mounting of the supporting arm of a furniture hinge, height adjustment is brought about by the fact that the mounting plate is divided into a bottom part (12) which can be affixed to the surface of the cabinet wall and a top part (14) which is displaceable in the direction of height on the bottom part and can be fixed at selected levels. In the mounting plate (10) one of the wings (20) is formed on the bottom part (12) and the other wing (18) on the top part (14), the bottom part reaching into an opening in the bottom of the wing (18) of the top part (14) and thus assuring guidance of the top part (14) on the bottom part (12) in the adjusting procedure.

11 Claims, 2 Drawing Sheets

MOUNTING PLATE FOR FURNITURE HINGES

Figure 1:
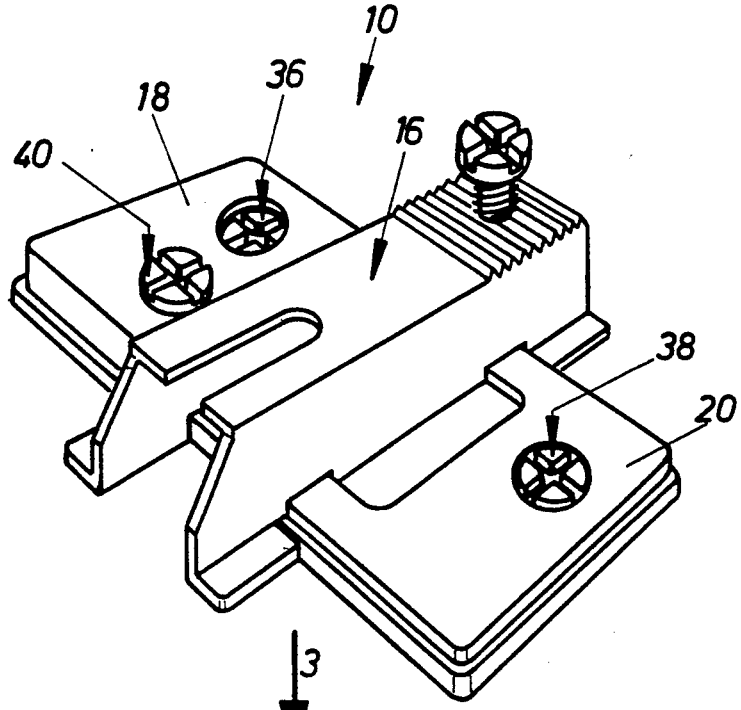

The invention relates to a mounting plate for the adjustable fastening of the supporting-wall-related part, configured as a supporting arm, of a furniture hinge on a cabinet carcase, with a bottom part to be placed directly on the supporting wall of the carcase and a middle section provided with fastening means for the supporting arm, which is displaceable on this bottom part parallel to the hinge pivot axis by means of guiding means adapted to one another, and can be selectively locked thereon, and which projects from the supporting wall, and from each of whose opposite sides a wing-like projection extends, at least one slot running in the direction of displacement being provided in one of the wing projections, through which passes the threaded shaft of a locking screw threaded into a tap in the bottom part.

For the adjustable fastening of furniture hinges with a supporting-wall-related part configured as an elongated supporting arm, bipartite, height-adjustable mounting plates are known (DE-OS 20 43 622), in which an elongated bottom part can be attached by mounting screws to the supporting arm of the cabinet carcase, and the top part, guided on the bottom part in the height-adjusting direction by interfitting tongues and grooves, can be locked on the bottom part by at least one separate set screw. On the other hand, mounting plates with wing-like projections extending from the opposite longitudinal sides of an elongated middle section—so-called "wing plates"—are known, in which fastening bores are provided, so that the fastening of such "wing plates" in bores provided in the supporting wall of a cabinet carcase at a vertical distance from one another, e.g., in bores of a front row intended for holding shelf supports, can be performed. Such wing plates have already been made in the form of bipartite, height-adjustable mounting plates (DE-OS 26 24 453), the height adjustment being made possible by slots provided in the wing projections of the upper part through which the shafts of the mounting screws are driven into the associated mounting bores in the supporting wall. When the mounting screws are loosened the upper part is then adjustable for height within the dimension provided by the slots. Without loosening the mounting screws a height adjustment is possible in the case of a wing plate (DE-OS 30 22 440) which is fastened on the supporting wall by a mounting screw driven through each of associated bores in the wing projections of the bottom part. For the height adjustment, the set screw is loosened and the upper part is shifted on the bottom part, i.e., the mounting screws holding the mounting plate on the supporting wall do not have to be loosened. In this known hinge the upper part is guided on the bottom part in the direction of displacement, while it reaches under the lateral margins of the wing projection which run in the height-adjusting direction, so that an interlocking security is provided against separation of the upper part from the bottom part. With this configuration, however, undercut grooves exist along the edges of the wing projections of the upper part and if the upper part is made from die-cast metal they call for complicated and accordingly expensive casting dies equipped with sliders. Manufacturing the mounting plate parts by stamping and pressing them from sheet metal is not possible at all at reasonable cost, although the manufacture of furniture hardware from sheet metal is increasingly preferred for reasons of cost and sturdiness.

The invention is addressed to the problem of creating a bipartite, height-adjustable mounting plate whose top and bottom parts can be manufactured by pressing and stamping from sheet metal, while assuring a precise guidance, with little free play, of the top part on the bottom part when height adjustments are made.

Setting out from a mounting plate of the kind referred to above, this problem is solved in accordance with the invention in that the one wing projection is an integral part of the upper part and has on its bottom facing the supporting wall a recess open to the middle section, while the second wing projection is a portion of the bottom part which on the side opposite the wing projection extending from the top part passes through the middle section into the open recess of the wing projection integral with the top part and has lateral boundary surfaces displaceably guided on correspondingly associated lateral boundary surfaces of the recess, that on the side of the middle section opposite the upper part provided with the integral wing projection a shorter projection extends integrally in the direction of displacement, which reaches through a cut-out in the upper side of the wing projection formed from the bottom part into a recess formed in the supporting-wall-facing bottom of the wing projection, and that the cut-out in the wing projection of the bottom part parallel to the length of the middle portion has a length corresponding to the width of the shorter upper part projection measured in this direction, but at right angles thereto, measured in the direction of displacement, it has a width which corresponds substantially to the planned amount of height displacement of the mounting plate, while the short upper part projection, measured in the direction of displacement, protrudes from the middle section by an amount which is greater than the height displacement dimension. Of the two wing projections, therefore, one is an integral part of the top part, while the second is formed by a portion of the bottom part. In an advantageous further development of the invention, the bottom part has in each of its areas lying on opposite sides of the middle section a bore for a mounting screw so that it can be screwed onto the supporting wall of a cabinet carcase in the proper position. Alternative possibilities for mounting, for example the provision of pins to be pressed or driven [into the wall] on the bottom part and the setting of these pins in associated bores in the supporting wall of the cabinet carcase, are not excluded.

The wing projection integral with the top part can best have, in the area covering the bore for the mounting screws in the bottom part, an opening whose diameter is approximately equal to or slightly greater than the head of the mounting screw, so that this mounting screw will be accessible even in the installed state of the hinge and the mounting plate can thus be unscrewed as a whole from the supporting wall. The slot provided for the set screw is best provided in the wing projection integral with the top part, this slot being best offset laterally from the opening for the head of the mounting screw.

The short projection from the top part, which passes through the cut-out in the wing projection of the bottom part, can best have in its free end portion lying in the recess of the wing projection of the bottom part, in alignment with the bore provided for the passage of the mounting screw, a recess in the edge of its free end whose width is at least equal to the width of the diameter of the mounting screw. In this way it is possible to have the top-part projection extend relatively far from the middle portion without limiting the size of the height adjustment by the shaft of the mounting screw fastening the wing projection of the bottom part on the supporting wall.

The top part and/or the bottom part can be made by pressure casting from metal in a known manner. Preferably, however, the top part and/or the bottom part are made from sheet metal by stamping and pressing.

The configuration is preferably made such that the bottom part is embossed so that in the assembled state it will rest substantially only with its edges on the corresponding supporting wall of the carcase, and that the bottom part will be provided in the area of its mounting bores with counterbores for the heads of the mounting screws, the depth of the counterbores being such that the bottoms of the counterbores will be flush with the plane of the supporting edges. This will assure that, even if it is made from relatively thin sheet metal, the bottom part will not be deformed by the heads of the mounting screws causing the height adjustment to be stiff or causing the top part to be held too tightly on the bottom part. Furthermore, the heads of the mounting screws will not protrude from the bottom part, so that in the wing projection of the top part there will be no need to provide a slot in the area above the associated mounting screw of the bottom part.

Figure 2:
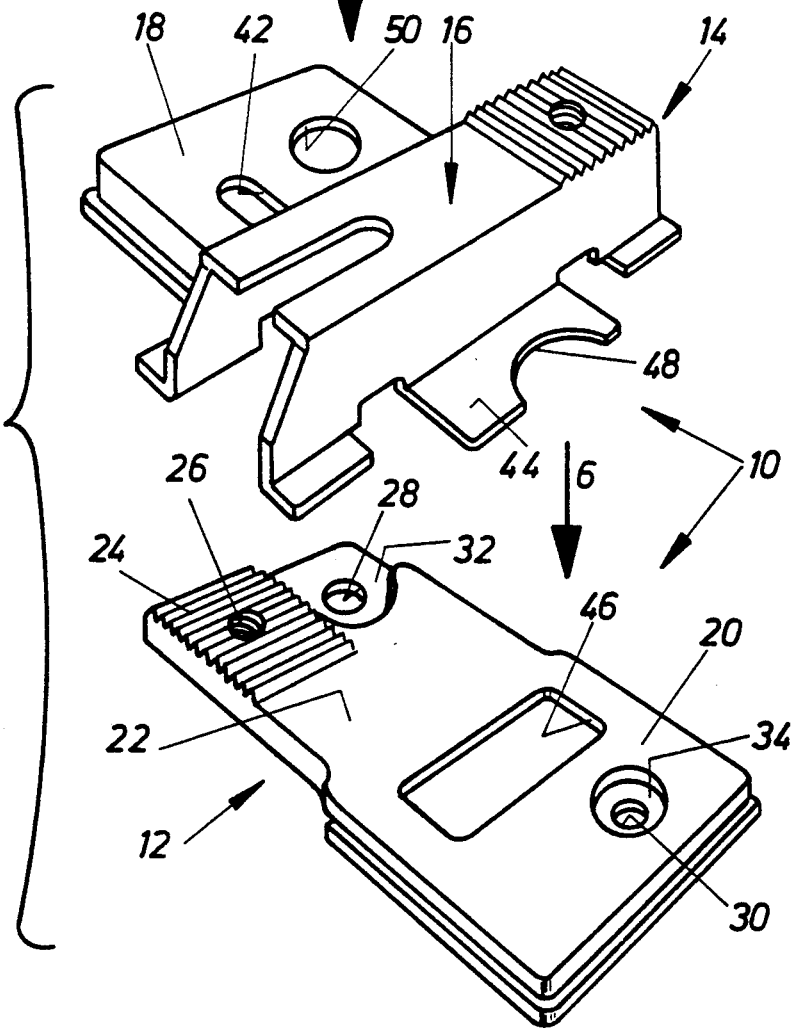
Figure 3:
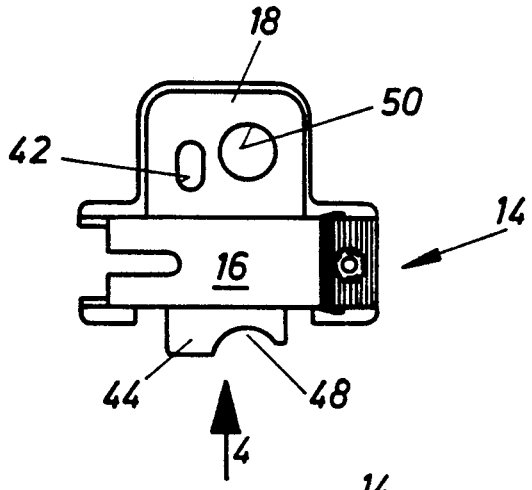
Figure 4:
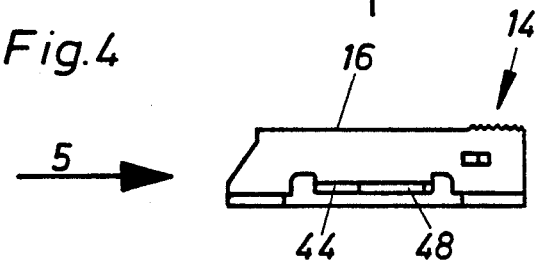
Figure 5:
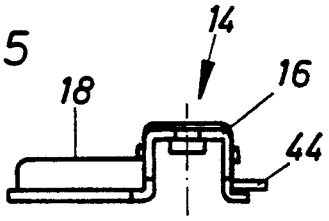
Figure 6:
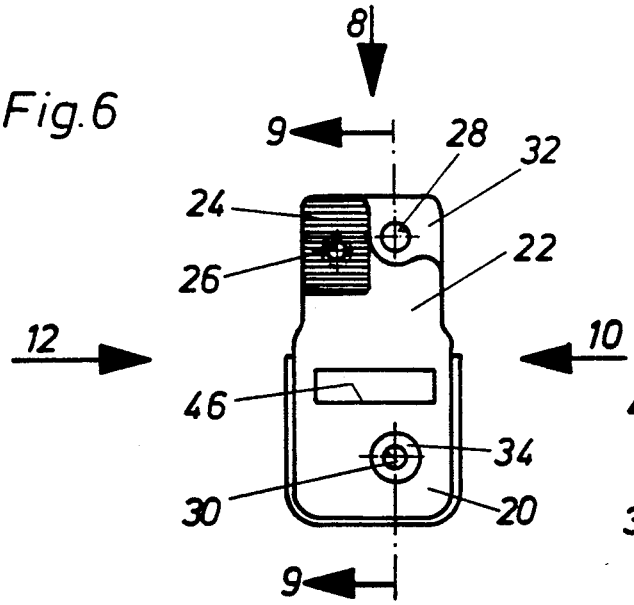
Figure 9:
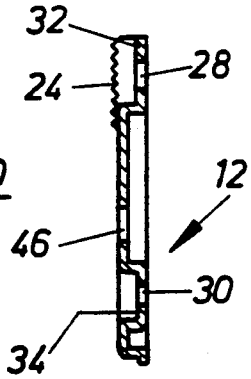
Figure 10:
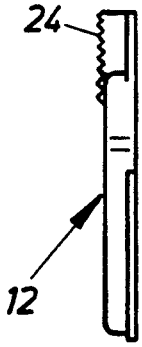
Figure 7:
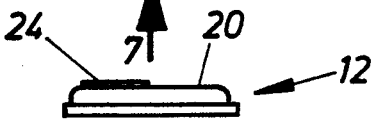
Figure 8:
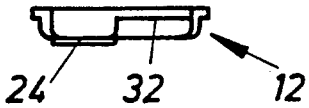

The invention is further explained in the following description of an embodiment, in conjunction with the drawing wherein:

FIG. 1 is a perspective view of a height-adjustable mounting plate configured in the manner of the invention, FIG. 2 is an exploded view of the mounting plate shown in FIG. 1, FIG. 3 is a top plan view of the mounting plate's top part seen in the direction of the arrow 3 in FIG. 2, FIG. 4 is a side view of the top part seen in the direction of arrow 4 in FIG. 3, FIG. 5 is a front elevation of the top part seen in the direction of arrow 5 in FIG. 4, FIG. 6 is a plan view of the bottom part of the mounting plate, seen in the direction of arrow 6 in FIG. 2, FIG. 7 is a side elevation of the wing projection of the bottom part, seen in the direction of arrow 7 in FIG. 6, FIG. 8 is a side elevation of the section of the bottom part lying within the wing projection of the top part, seen in the direction of arrow 8 in FIG. 6, FIG. 9 is a sectional view seen in the direction of arrows 9—9 in FIG. 6, and FIG. 10 is a view of the bottom part seen in the direction of arrow 10 in FIG. 6.

The mounting plate shown in FIGS. 1 and 2, indicated in its entirety by 10, is composed of a bottom part 12 which can be fastened directly on the supporting wall of a cabinet carcase, and a top part 14 which is displaceable within the given range on the bottom part and can be locked thereon at selectable positions, both parts in the case depicted being made from sheet metal by stamping and pressing, although manufacture by the pressure-casting method from zinc alloy (Zamak) is possible. The mounting plate 10 has, in the usual manner, an elongated middle portion 16 protruding from the supporting wall and intended for the adjustable mounting of the supporting-wall-related part, configured as a supporting arm, of a furniture hinge (not shown), and for locking it in selectable positions. From each of the opposite sides of the middle portion 16 a low, wing-like projection 18 and 20 extends. The wing-like projection 18 is an integral part of the top part 14 represented separately in FIGS. 3 to 5, and the wing-like projection 20 is an integral part of the bottom part 12 represented separately in FIGS. 6 to 10.

The tabular bottom part 12 is a body stamped from a sheet metal blank to form a substantially flat-surfaced plate which is then embossed so that it has the shape of an inverted shallow pan, i.e., one which has its hollow side down, facing an associated supporting wall. Only the edges of the bottom part will thus be in contact with the wall, with the exception of the areas described below.

In FIGS. 2 and 6 it can be seen that one side of the portion of the bottom part 12 that forms the wing-like projection 20 adjoins an area 22 of slightly reduced width which, when the mounting plate 10 is in the installed state, extends underneath the middle portion 16 and into the likewise embossed wing-like projection 18 of the top part, its width being such that the lateral boundary surfaces fit snugly between the confronting inner surfaces of the marginal portions of the wing-like projection 18. The wing-like projection 18 is thus guided for displacement on the portion 22 of reduced width on the bottom part 12. In the portion 22, within a section 24 provided with serrations running parallel to the middle section 16, a tap 26 is provided plus, laterally offset from the section 24, a mounting hole 28 through which a mounting screw can be driven into the wall of a cabinet carcase. The mounting hole 28, like another mounting hole 30 provided in the opposite portion forming the wing-like projection 20, is disposed within one of the counterbores 32 and 34 provided for the heads of the mounting screws. The depth of the counterbore is selected such that the side of the counterbore facing the supporting wall will be flush with the plane of the rim of the bottom part. That is to say, mounting screws 36 and 38, (FIG. 1) driven into the wall through the mounting bores 28 and 30, thrust in the driven state against the bottom of the associated counterbores 32 and 34, respectively, whose bottoms in turn are urged against the supporting wall. Deformation of the bottom part by tightening the mounting screws 36 and 38 is therefore impossible.

A setscrew 40 is driven into the tap 26 and in the tightened state urges the top part 14 onto the bottom part 12 and thus secures it against displacement at right angles to the length of the middle portion 16. When the setscrew 14 is loosened, however, such displacement is possible within an established range, a slot 42 being provided for this purpose in the wing-like projection 18 of the top part in alignment with the tap 26 in the bottom part, its length determining the length of the displacement of the top part 14 on the bottom part.

On the side opposite the projection 18, a shorter and narrower, flat projection 44 extends from the middle portion 16 of the top part, and is passed through a substantially rectangular cut-out 46 (FIGS. 2, 6 and 9) in the bottom part and rests on the inside surface of the portion of the bottom part that forms the wing-like projection 20. The projection 44 therefore secures the top part 14 on the side opposite the projection 18 against lifting away from the bottom part 12. It is clear that the width of section 46, measured in the direction of the displacement of the top part on the bottom part, must be selected according to the length of the slot 42 in order to permit the necessary movement. The width of projection 44 measured in the direction of the length of the middle portion 16, however, is selected so that it corresponds substantially to the length of the cut-out 46 measured in the same direction.

The arcuate recess 48 in projection 44, which can be seen in FIGS. 2 and 3, is provided in order to prevent the edge of projection 44 from coming in contact with the counterbore 34 of the bottom part.

In the wing-like projection 18 of the top part 14, another opening 50 is provided in alignment with the mounting bore 28 of the bottom part 12; its diameter is slightly larger than the head of the mounting screw 36. It is thus possible to unscrew the mounting plate 10 as a unit from the supporting wall, i.e., without loosening the set screw 40 and lifting the top part 14 from the bottom part 12, since the head of the mounting screw 36 is accessible through the opening 50.

I claim:

1. A mounting plate, said mounting plate being suited for adjustably fastening a supporting wall part, shaped as a supporting arm, of a furniture hinge on a cabinet carcase, said mounting plate comprising:

a bottom part to be placed directly on the supporting wall of the carcase;

an upper part being displacable on said bottom part in a direction parallel to a hinge pivot axis by means of guiding means adapted to one another, and can be selectively locked thereon;

said upper part having an elongated middle section provided with fastening means for the supporting arm of the furniture hinge, said middle section having opposite sides, from one of which said opposite sides a first wing projection forming an integral part of said upper part extends, having at least one slot running in the direction of displacement, a set screw having a threaded shaft which passes through said at least one slot and is threaded into a tap in said bottom part;

said first wing projection having a bottom portion facing the supporting wall of the carcase, said bottom portion having a recess which is open to said middle section;

a second wing projection forms a projection of said bottom part which has a side opposite said first wing porting that extends from the upper part, said bottom of said second wing portion passes through said middle section into said open recess of said first wing projection integral with said upper part, and said bottom of said second wing portion has lateral boundary surfaces displaceably guided on correspondingly associated lateral boundary surfaces of said recess;

a shorter projection extends integrally on a side of said middle portion opposite said upper part provided with said first integral wing projection, said shorter projection extending integrally in the direction of displacement and reaching through a cut-out in an upper side of said second wing projection into a recess formed in the support wall facing bottom of said second wing projection, said cut-out being parallel to longitudinal direction of said middle section and having a length corresponding to the length of said shorter projection of said upper part measured in said longitudinal direction, and at right angles thereto, as measured in the direction of displacement, said cut-out has a width corresponding substantially to a maximum amount of displacement of said mounting plate, said shorter projection protruding from said middle section, as measured in the direction of displacement, has a width by an amount which is greater than the maximum amount of displacement.

2. Mounting plate according to claim 1, wherein the bottom part has in each of its areas lying on opposite sides of the middle section a bore for a mounting screw.

3. Mounting plate according to claim 2, wherein said first wing projection for the mounting screw has in the area covering the bottom part an opening whose diameter is about equal to or slightly greater than the head of the mounting screw.

4. Mounting plate according to claim 3, wherein the slot for the set screw is laterally offset from the opening for the head of the mounting screw.

5. Mounting plate according to claim 2, wherein the slot provided for the passage of the threaded shaft of the set screw is provided in said first wing projection.

6. Mounting plate according to claim 2, wherein said shorter projection lying in the cut-out in said second wing projection, in alignment with the bore provided for the passage of the mounting screw, a recess in its free terminal edge, whose width is at least equal to the width of the diameter of the mounting screw.

7. Mounting plate according to claim 2, wherein the bottom part is hollow-embossed such that in the installed state it rests substantially along its marginal area on the corresponding carcase supporting wall, and that the bottom part is provided in the area of its mounting bores with counterbores for the heads of the mounting screws, whose depth is such that the bottoms of the counterbores lie flush in the plane of support of the marginal area.

8. Mounting plate according to claim 1, wherein said upper part is made from metal by the pressure casting process.

9. Mounting plate according to claim 1, wherein the top part is made from sheet metal by the stamping and pressing method.

10. Mounting plate according to claim 1, wherein the bottom part is made from material by the pressure casting process.

11. Mounting plate according to claim 1, wherein the bottom part is made from sheet metal by the stamping and pressing method.

* * * * *